US011131105B2

(12) United States Patent
Sung et al.

(10) Patent No.: US 11,131,105 B2
(45) Date of Patent: Sep. 28, 2021

(54) ANNULAR REINFORCING STRUCTURE

(71) Applicant: National Applied Research Laboratories, Taipei (TW)

(72) Inventors: Yu-Chi Sung, Taipei (TW); Chin-Kuo Su, Taipei (TW); Hsiao-Hui Hung, Taipei (TW); Chia-Chuan Hsu, Taipei (TW); Chia-Wei Hsu, Taipei (TW)

(73) Assignee: National Applied Research Laboratories, Taipei (TW)

( * ) Notice: Subject to any disclaimer, the term of this patent is extended or adjusted under 35 U.S.C. 154(b) by 0 days.

(21) Appl. No.: 16/886,162

(22) Filed: May 28, 2020

(65) Prior Publication Data

US 2021/0214959 A1 Jul. 15, 2021

(30) Foreign Application Priority Data

Jan. 14, 2020 (TW) ..... 109101202

(51) Int. Cl.
*E04G 21/14* (2006.01)
*E04B 1/18* (2006.01)

(52) U.S. Cl.
CPC ..... *E04G 21/14* (2013.01); *E04B 1/18* (2013.01)

(58) Field of Classification Search
None
See application file for complete search history.

(56) References Cited

U.S. PATENT DOCUMENTS 5,797,228 A * 8/1998 Kemeny ..... E04H 9/022 248/632
2004/0128921 A1* 7/2004 Mualla ..... E01D 11/04 52/167.1
2009/0286910 A1* 11/2009 Bloomfield ..... C08L 53/025 524/269
2016/0265212 A1* 9/2016 Sung ..... E01D 19/02

FOREIGN PATENT DOCUMENTS

JP S561904 U 1/1981
TW 464720 B 11/2001
WO WO 2006090723 A1 8/2006

* cited by examiner

*Primary Examiner* — Joshua K Ihezie
(74) *Attorney, Agent, or Firm* — Muncy, Geissler, Olds & Lowe, P.C.

(57) ABSTRACT

An annular reinforcing structure for the reinforcement of a supporting structure of a construction is provided. The annular reinforcing structure includes an outer frame body, an inner frame body and an elastic body. The inner frame body is connected to the outer frame body and positioned therein. The inner frame body and the outer frame body together define an annular space. The elastic body is accommodated in the annual space between the inner frame body and the outer frame body.

9 Claims, 4 Drawing Sheets

ANNULAR REINFORCING STRUCTURE

CROSS REFERENCE TO RELATED APPLICATION

This application claims the benefits of the Taiwan Patent Application Serial Number 109101202, filed on Jan. 14, 2020, the subject matter of which is incorporated herein by reference.

BACKGROUND OF THE INVENTION

1. Field of the Invention

The present invention relates to an annular reinforcing structure, particularly to an annular structure for the reinforcement of a supporting structure of a construction.

2. Description of Related Art

The supporting structure of a construction is typically comprised of a number of pillars disposed on a foundation and inter-linked by a number of beams Many reinforcement techniques have been developed to enhance the seismic resistance of supporting structure of a construction, such as column jacketing, wing walls, bracing . . . etc. Shocking reduction or isolation devices such as dampers is sometime added to reduce damages to constructions caused by excessive lateral movements. Bracing reinforcement on supporting structure has been a common practice in recent years. That is to have multiple braces crossing one another in diagonal directions and connecting neighboring pillars and beams.

For example, a portal frame bridge makes use of multiple piers disposed on a foundation to perform as supporting structures of the bridge. Each bridge pier has at least two pillars and a beam. The two pillars are disposed on the foundation, and the beam connects the pillars. Therefore each bridge pier and the foundation define a hollow section. Many bridge piers and the foundation define many hollow sections that offer visual transparency to the bridge. However, existing brace reinforcing structure often utilizes at least two braces crossing each other in each hollow section, and connects each bridge pier and the foundation at the same time.

Existing brace reinforcing structure does not only affect visual transparency by occupying spaces between bridge piers and the foundation, but also partially damage structures of bridge piers and foundation when rivets have to be used. Because a brace is longer and heavier, rivets and other parts have to be disposed inside the bridge piers and foundation before braces can be attached thereto. Furthermore, existing braces are known to be difficult to transport, and complicated and time consuming to construct.

SUMMARY OF THE INVENTION

The object of the present invention is to provide an annular reinforcing structure, including an outer frame body and an inner frame body to define an annular space, and to fill the annular space with an elastic body. When external forces, such as earthquakes shaking a building, are applied to the annular reinforcing structure, the elastic body may deform under pressure and effectively absorb such external forces. Hence the annular reinforcing structure of the present invention may achieve the effect of eliminating such external forces. It may also push the outer frame body and the inner frame body back to their original positions, so that the annular reinforcing structure may recover its position after earthquakes. Since the present invention utilizes material characteristics of the elastic body to achieve shock absorption, the structure is much simpler than commonly known dampers.

Another object of the present invention is to provide an annular reinforcing structure to avoid affecting the visual transparency of a construction with the unique hollow section defined by the inner frame body.

Yet another object of the present invention is to provide an annular reinforcing structure that may be dismantled into smaller annular reinforcing units, so they may be conveniently transported to the construction site. Those smaller annular reinforcing units may be quickly assembled to an annular reinforcing structure and integrated into the construction on site. The construction efficiency may be greatly improved.

To achieve above mentioned objects, the present invention provides an annular reinforcing structure for reinforcement of a supporting structure of a construction. The annular reinforcing structure includes an outer frame body, an inner frame body and an elastic body. The inner frame body is connected to the outer frame body and positioned therein. The inner frame body and the outer frame body together define an annular space. The elastic body is accommodated in the annular space between the inner frame body and the outer frame body.

The supporting structure of the construction includes a foundation, a number of pillars and a beam. The pillars are disposed on the foundation with intervals. The beam is opposite the foundation and connects the pillars, so that the pillars, foundation and beam altogether define an inner circumference. The outer frame body is surrounded and attached to the inner circumference when the annular reinforcing structure and the supporting structure are integrated.

The elastic body includes a plurality of elastic units, and the elastic units are arranged adjacent to one another in the annular space, and each of the elastic units respectively in contact with the outer frame body and the inner frame body.

The inner frame body is oval shaped and defines a hollow portion that is surrounded by the annular space.

Each elastic unit has at least a section that is circular in cross section.

The outer frame body includes a plurality of outer frames, the inner frame body includes a plurality of inner frames, and each of the outer frames connects to a respective one of the inner frames to define an annular sub space. The elastic units are arranged adjacent to one another in the annular sub space to form an annular reinforcing unit. The annular reinforcing structure is comprised by the annular reinforcing units connected in order. The annular space is defined by the annular sub spaces connected in order.

Each of the outer frames is "L" shaped, and each of the inner frames is arc shaped. Each of the inner frames has a convex facing a respective one of the outer frames. Each of the inner frames and each of the outer frames are integrally formed.

Each of the elastic units is a cylinder.

The elastic body has elasticity higher than that of the outer frame body and that of the inner frame body.

The material of the outer frame body and the inner frame body are metal, and the material of the elastic body is thermosetting polymer.

Purposes, technical details and other features of the present invention will become readily apparent upon further review of the following embodiments and drawings.

DETAILED DESCRIPTION OF THE PREFERRED EMBODIMENT

Figure 1:
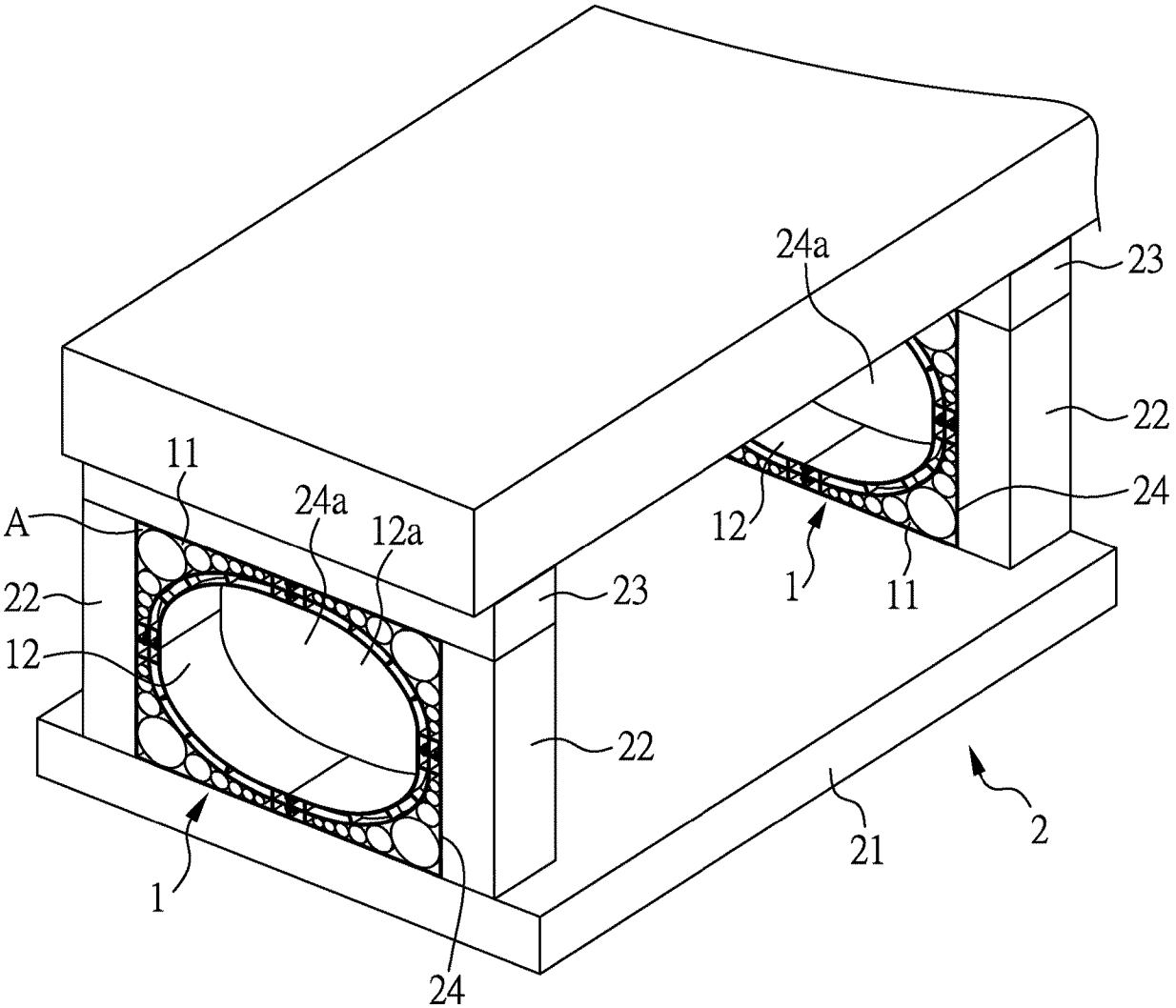
FIG. 1 is a partial perspective view of the illustration of an embodiment of the annular reinforcing structure integrated in a supporting structure of a construction according to the present invention.

The present invention may be understood further by reference to the following description taken in conjunction with the accompanying drawings, in which like reference numerals designate like parts throughout the drawings.

Figure 2:
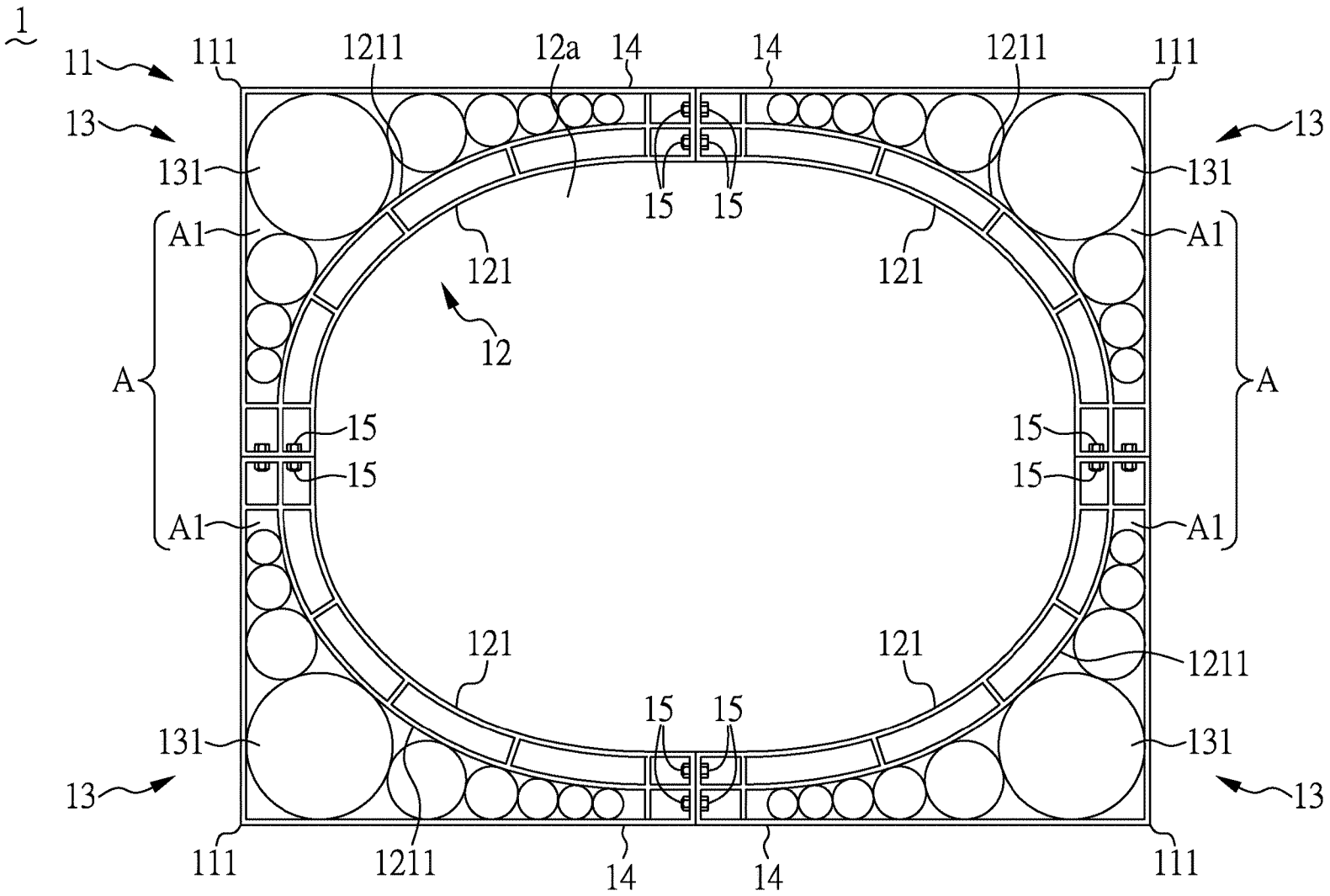
FIG. 2 is a front view of the illustration of the embodiment of the annual reinforcing structure according to the present invention.
Figure 3:
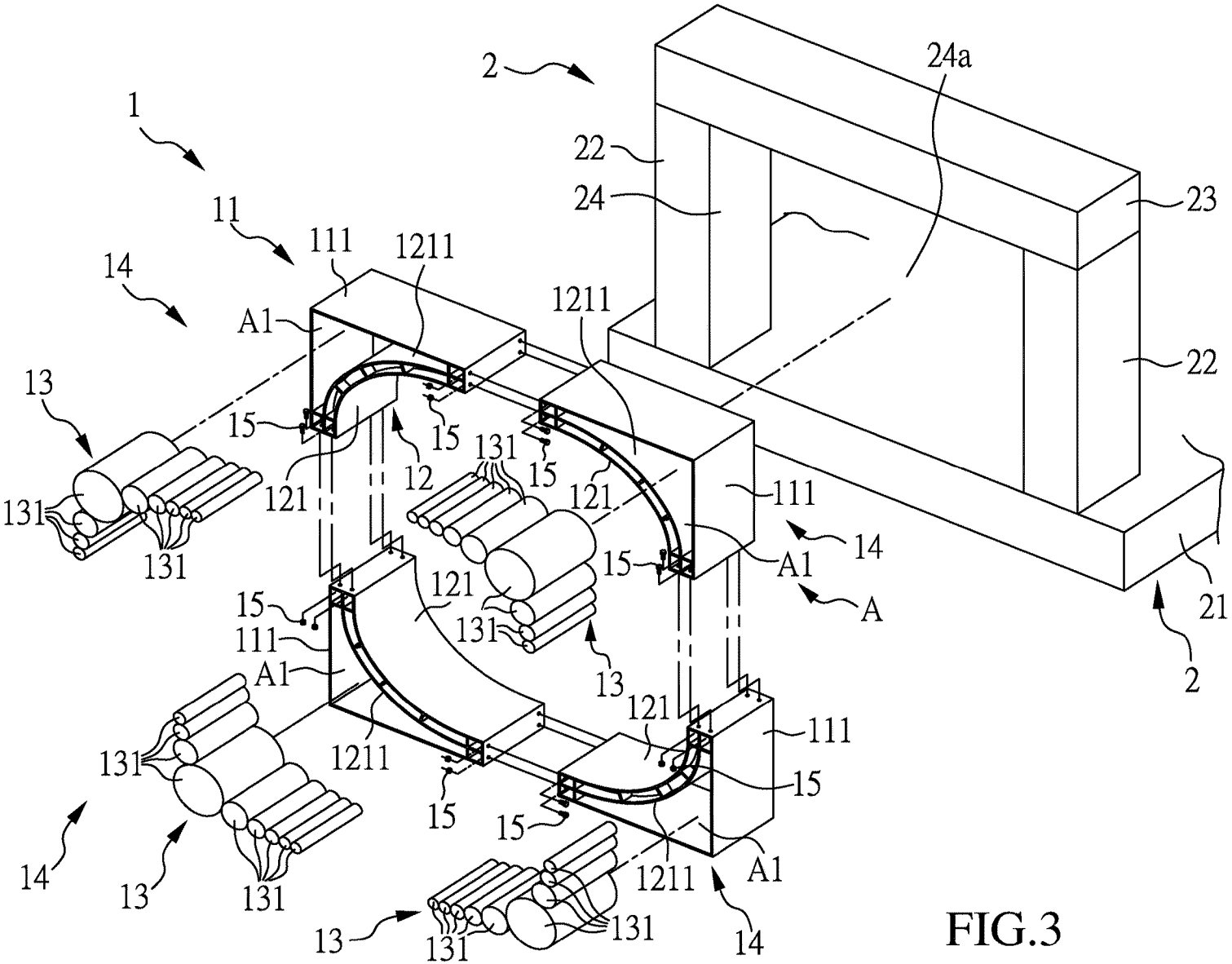
FIG. 3 is an assembly illustration of the embodiment of the annular reinforcing structure according to the present invention.
Figure 4:
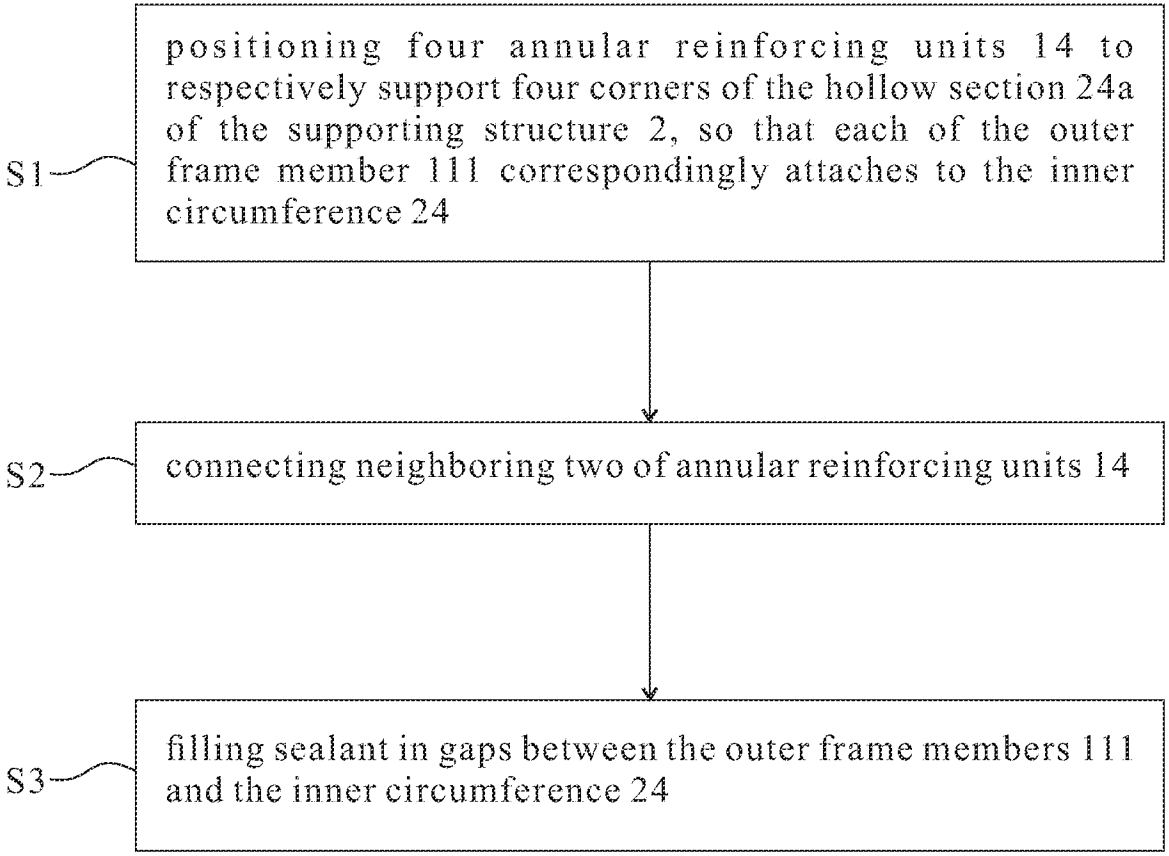
FIG. 4 is a flow chart of the quick construction of the annular reinforcing structure according to present invention.

The annular reinforcing structure 1 of the present invention is for enhancing a supporting structure 2 of a construction such as a bridge. An embodiment of the present invention will be explained using a supporting structure 2 of a construction in the following paragraph. FIG. 1 is a partial perspective view of the illustration of the embodiment of the annular reinforcing structure 1 integrated in the supporting structure 2 of the construction according to the present invention. FIG. 2 is a front view of the illustration of the embodiment of the annual reinforcing structure 1 according to the present invention. FIG. 3 is an assembly illustration of the embodiment of the annular reinforcing structure 1 according to the present invention. FIG. 4 is a flow chart of the quick construction of the annular reinforcing structure 1 according to present invention. The support structure 2 of the construction is first described. As shown in FIGS. 1 and 3, the support structure 2 of the construction includes a foundation 21 and a number of piers. Each of the piers has two opposite pillars 22 and a beam 23, wherein the pillars 22 are disposed on the foundation 21 and spaced apart from each other. The beam 23 connects the pillars 22 and is opposite to the foundation 21. Therefore, the foundation 21, the pillars 22 and beam 23 together define an inner circumference 24 and a hollow section 24*a* of the support structure 2. A number of piers and the foundation 21 jointly define a number of hollow sections 24*a* and provide the construction a sense of visual transparency.

Now the structure of the embodiment of the annular reinforcing structure 1 of the present invention is detailed. As shown in FIGS. 2 and 3, the annular reinforcing structure 1 includes an outer frame body 11, an inner frame body 12 and an elastic body 13. The inner frame body 12 is connected to the outer frame body 11 and positioned therein, and the outer frame body 11 and the inner frame body 12 define an annular space A. In this embodiment, the inner frame body 12 is oval shaped and defines a hollow portion 12*a*, thus the hollow portion 12*a* is surrounded by the annular space A. The elastic body 13 includes a plurality of elastic units 131 disposed adjacent to one another in the annular space A, and between the outer frame body 11 and the inner frame body 12. As shown in FIG. 1, the outer frame body 11 surrounds and attaches to the inner circumference 24 when the annular reinforcing structure 1 and the supporting structure 2 are integrated. Because the annular reinforcing structure 1 has a hollow portion 12*a*, it does not occupy the hollow section 24*a* of the supporting structure 2 and maintains a visual transparency of the construction when being integrated in support structure 2.

As shown in FIG. 3, the outer frame body 11 includes four outer frame members 111, and the inner frame body 12 includes four inner frame members 121. In this embodiment, each outer frame member 111 is "L" shaped, and each inner frame member 121 is arc shaped. Each elastic unit 131 is a cylinder; hence the cross section of each elastic unit 131 is circular. Each of the inner frames members 121 has a convex 1211 facing a respective one of the outer frame members 111. In this embodiment, the two ends of each inner frame member 121 and the two ends of each outer frame member 111 are connected, and a plurality of elastic units 131 are disposed therebetween to form an annular reinforcing unit 14. The annular reinforcing unit 14 is substantially a triangle. In other words, the annular reinforcing structure 1 of the present invention comprises of four annular reinforcing units 14, with each annular reinforcing unit 14 defining an annular sub space A1. The annular space A of the annular reinforcing structure 1 is defined by the plurality of annular sub spaces A1 jointly. Therefore the annular space A may be divided into four annular sub spaces A1 in this embodiment.

Each of the elastic unit 131 is arranged adjacently in each of the annular sub spaces A1. As shown in FIG. 3, the annular sub space A1 is substantially triangular, and the elastic units 131 are of different diameters so they can adjacently fill up the triangle shaped annular sub space A1. Because the elastic units 131 may recover from compression, each of the elastic units 131 only needs to be slightly compressed to fit into the annular sub spaces A1 in actual assembly. The elastic units 131 in the annular sub spaces A1 recover from compression to their original shapes and tightly fit between the outer frame member 111 and the inner frame member 121 without requiring any other parts to fix the elastic units 131 in the annular sub space A1. Assembling costs are hence reduced with this simple structure of the annular reinforcing structure 1 of the present invention.

As above mentioned, the annular reinforcing structure 1 of the present invention may be produced with a plurality of annular reinforcing units 14 pre manufactured in factories. Smaller annular reinforcing units 14 may be separately transported to the construction site, so that the annular reinforcing structure 1 may be transported conveniently. The present invention also provides a method of quick reinforcement of the supporting structure 2 of a construction using the annular reinforcing structure 1 (refer to FIG. 4). Step S1 is positioning four annular reinforcing units 14 to respectively support four corners of the hollow section 24*a* of the supporting structure 2, so that each of the outer frame members 111 correspondingly attaches to the inner circumference 24. Step S2 is connecting neighboring two of annular reinforcing units 14 (bolts 15 are utilized to connect the annular reinforcing units 14 in this embodiment). Through two simple steps mentioned above, the annular reinforcing structure 1 of the present invention would be quickly assembled, abutting and reinforcing the inner circumference 24 of the supporting structure 2.

In this embodiment, the length and width of the outer frame body 11 are substantially equal to that of the hollow section 24*a*, allow the outer frame body 11 to firmly engage in the hollow section 24*a*. There may be gaps between the annular reinforcing structure 1 and the inner circumference 24 in other embodiments of the present invention. A further step S3 is filling sealant in gaps between the outer frame members 111 and the inner circumference 24. The sealant may be selected from none shrinking mortar or epoxy resin.

In contrast to existing diagonal bracing reinforcing structure that requires partial damages to the pillars or beams to allow fixing members such as rivets to connect the supporting structure and the reinforcing structure, the annular reinforcing structure 1 of the present invention is advantageous in reinforcing the support structure by direct engaging without damaging any pillars or beams.

In this embodiment, the outer frame body 11 and the inner frame body 12 are made of steel, and the elastic body 13 is made of vulcanized rubber. The elasticity of the elastic body 13 is higher than that of the outer frame body 11 and inner frame body 12. The outer frame body 11 extends from the foundation 21 to the pillars 22 and the beams 23, and abuts the inner circumference 24 of the supporting structure 2 to provide complete support to the supporting structure 2. Furthermore, lateral forces are the greatest on joints between the pillars 22 and the beam 23 and foundation 21 (four corners of the hollow section 24*a*) when the construction shakes during earthquakes, and the supporting structure 2 tends to breaks from such joints. Through connections of oval shaped inner frame body 12 and outer frame body 11, the four corners of the hollow section 24*a* in the annular reinforcing structure 1 of the present invention are triangular. Supports to four corners of the hollow section 24*a* are further enhanced.

Finally, earthquakes cause the construction to shake and hence lateral forces on the supporting structure 2. Through the elastic body 13 disposed between the outer frame body 11 and the inner frame body 12, the lateral forces transmit from the supporting structure 2 to the outer frame body 11, and then to the elastic body 13 that effectively absorbs the impacts in its compression process. The elastic body 13 also buffers and prevents collisions between the outer frame body 11 and the supporting structure 2. The elastic body 13 has high elasticity and may quickly recover to its original shape to press on the outer frame body 11 and the inner frame body 12 when the earthquake stops. The outer frame body 11 and the inner frame body 12 are pressed to recover their original positions; hence the annular reinforcing structure 1 of the present invention may recover its original position.

Furthermore, the annular reinforcing structure 1 of the present invention has the flexibility of adapting to different supporting structures 2 with different quantities, sizes, shapes and locations of the elastic units 131 of the elastic body 13. For example, the center portion of each corner of the hollow section 24*a* sustains the greatest stress, and the elastic units 131 of the largest diameter are disposed thereto to absorb the most lateral forces (as shown in FIGS. 2 and 3, each corner is disposed of the elastic unit 131 of the largest diameter). Although the elastic units 131 in this embodiment are cylinder, they may also be ball or other shapes in other embodiments of the present invention. When the elastic units 131 are ball shaped, at least two cross sections of each elastic unit 131 are round.

It should be noted that material of the outer frame body 11 and the inner frame body 12 may be metal, and the material of the elastic body 13 may be thermosetting polymers, but not limited hereto. The annular reinforcing structure 1 comprises of four annular reinforcing units 14 in this embodiment, but the number of annular reinforcing units 14 may be altered to adapt to the size and shape of the supporting structure 2 in other embodiments. The outer frame body 11 and the inner frame body 12 are integrally formed instead of a plurality of annular reinforcing units 14.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

What is claimed is:

1. An annular reinforcing structure for enhancing a supporting structure of a construction, comprising:

an outer frame body;

an inner frame body, connected inside the outer frame body and defining an annular space therewith wherein the inner frame body is oval shaped and defines a hollow portion surrounded by the annular space;

an elastic body, accommodated in the annular space between the outer frame body and the inner frame body.

2. The annular reinforcing structure of claim 1, wherein each of the support structures includes a foundation, at least two pillars and a beam; the pillars are disposed on the foundation with intervals; the beam is opposite to the foundation and connects the pillars, so that the foundation, the pillars and the beam together define an inner circumference of the support structure; the outer frame body surrounds and attaches to the inner circumference when the annular reinforcing structure is attached to the supporting structure.

3. The annular reinforcing structure of claim 2, wherein the elastic body includes a plurality of elastic units arranged adjacent to one another in the annular space, and each of the elastic units is respectively in contact with the outer frame body and the inner frame body.

4. The annular reinforcing structure of claim 3, wherein each of the elastic units has at least one section that is annular in cross section.

5. The annular reinforcing structure of claim 4, wherein the outer frame body includes a plurality of outer frame members, the inner frame body includes a plurality of inner frame members, and each of the outer frame members connects to a respective one of the inner frame members to define an annular sub space; the elastic units are disposed adjacent to one another in the annular sub space to form an annular reinforcing unit; a plurality of the annular reinforcing units connect to one another to form the annular reinforcing structure; and the annular space is defined by a plurality of the annular sub spaces together.

6. The annular reinforcing structure of claim 5, wherein each of the outer frame members is L-shaped, each of the inner frame members is arc shaped, and each of the inner frame members has a convex surface facing a respective one of the outer frame members;

and each of the inner frame members and each of the outer frame members are integrally formed.

7. The annular reinforcing structure of claim 6, wherein each of the elastic units is a cylinder.

8. The annular reinforcing structure of claim 7, wherein the elastic body has a higher elasticity than that of the outer frame body and that of the inner frame body.

9. The annular reinforcing structure of claim 8, wherein the inner frame body and the outer frame body are made of metal, and the elastic body is made of thermosetting polymer.

* * * * *